United States Patent [19]

Kawasaki et al.

[11] Patent Number: 4,841,720

[45] Date of Patent: Jun. 27, 1989

[54] ROVING BOBBIN EXCHANGING METHOD AND APPARATUS FOR CARRYING OUT ROVING BOBBIN EXCHANGING METHOD

[75] Inventors: Yoshio Kawasaki; Tatutake Horibe, both of Fujieda; Kenji Sasaki, Komaki; Kazuo Yamada, Inazawa, all of Japan

[73] Assignee: Howa Machinery Ltd., Aichi, Japan

[21] Appl. No.: 273,348

[22] Filed: Nov. 18, 1988

Related U.S. Application Data

[63] Continuation-in-part of Ser. No. 91,209, Aug. 31, 1987, abandoned.

[30] Foreign Application Priority Data

Aug. 30, 1986 [JP] Japan ..... 61-202734

[51] Int. Cl.[4] ..... D01H 9/18; D01H 9/02; D01H 9/10

[52] U.S. Cl. ..... 57/281; 57/268; 57/276

[58] Field of Search ..... 57/261, 90, 266–268, 57/270, 276, 278, 281

[56] References Cited

U.S. PATENT DOCUMENTS 3,773,191 11/1973 Ishida ..... 57/281 X
3,788,054 1/1974 Haussmann et al. ..... 57/281
4,438,622 3/1984 Pons ..... 57/266 X
4,473,997 10/1984 Kawasaki et al. ..... 57/276
4,583,358 4/1986 Krieger et al. ..... 57/281
4,586,326 5/1986 Igel ..... 57/276 X
4,630,435 12/1986 Igel ..... 57/281

*Primary Examiner*—John Petrakes
*Attorney, Agent, or Firm*—Michael N. Meller

[57] ABSTRACT

A method and apparatus for exchanging exhausted roving bobbins for full packaged roving bobbins applied to a conventional ring spinning frame provided with at least one roving supply rail arranged at a position in front of the spinning frame, at each side thereof, wherein a unit operation for exchanging exhausted roving bobbins suspended by front and back bobbin hangers, facing each other on a creel, for full packaged roving bobbins previously carried to the predetermined supply positions thereof on this supply rail, is carried out stepwisely from one side to the other side of the spinning frame along the creel, with regard to each pair of front and back bobbin hangers on the creel to which such a unit operation is to be applied, by utilizing only two pegs for temporarily supporting roving bobbins capable of changing the axial distance thereof between an axial distance (b) between the front and back bobbin hangers, facing each other on the creel, and an axial distance (a) between two adjacent bobbin hangers on the supply rail.

13 Claims, 12 Drawing Sheets

ROVING BOBBIN EXCHANGING METHOD AND APPARATUS FOR CARRYING OUT ROVING BOBBIN EXCHANGING METHOD

This is a continuation-in-part of application Ser. No. 091,209, filed Aug. 31, 1987 and now abandoned.

BACKGROUND OF THE INVENTION

1. Field of the Invention

The present invention relates to a roving bobbin exchanging method for a spinning frame and an apparatus for carrying out the roving bobbin exchanging method. More particularly, the present invention relates to a roving bobbin exchanging method for exchanging a pair of almost exhausted roving bobbins suspended by the front and back bobbin hangers of a creel of a conventional ring spinning frame for a pair of full packaged roving bobbins suspended by the bobbin hangers of a supply rail extended in front and above the creel of this spinning frame.

2. Description of the Related Art

When roving bobbins suspended by the bobbin hangers of a spinning frame become almost exhausted, they must be exchanged for full packaged bobbins.

Automation of the roving bobbin exchanging operation for spinning machines has been eagerly sought to reduce the manpower needed in the spinning process. For example, Japanese Unexamined Patent Publication (Kokai) No. 61-102428 discloses a roving bobbin exchanging method applied to a conventional ring spinning frame wherein, at each side of the frame, front and back rows of bobbin hangers of a creel are arranged along the longitudinal direction of the frame to supply rovings to the corresponding draft parts of the corresponding side of the frame. Two rows of supply rails are arranged along each creel of this spinning frame. A pair of front and back roving bobbins suspended by the corresponding bobbin hangers, one of which is supported by the front row and the other by the back row, are exchanged for full packaged roving bobbins suspended by the corresponding bobbin hangers of the supply rails, one of which is supported by the front supply rail and the other by the back supply rail. The above-mentioned bobbin exchanging operation is carried out sequentially from one end to the other of this spinning frame.

Japanese Unexamined Patent Publication (Kokai) No. 61-119728 discloses another roving bobbin exchanging method applied to a conventional ring spinning frame which utilizes a single supply rail. In this invention, alternate pairs of roving bobbins arranged in front and back rows, respectively, at regular bobbin pitches along the longitudinal direction of the spinning frame are exchanged for corresponding adjacent two full packaged roving bobbins suspended by the bobbin hangers of the single supply rail when the alternate pairs become almost exhausted.

The methods disclosed in the above-mentioned two Japanese unexamined patent publications employ two pairs of pegs, namely, a pair of pegs for displacing a pair of almost exhausted roving bobbins and a pair of pegs for displacing a pair of full packaged roving bobbins, to carry out the roving bobbin exchanging operation.

If an automatic piecing operation of rovings is required in combination with the above-mentioned roving bobbin exchanging operation, if the free end of the roving of each full packaged roving bobbin suspended by a bobbin hanger of the supply rail is first caught and then introduced to a running roving from an almost exhausted roving bobbin suspended by a corresponding bobbin hanger of the creel and pieced with the above-mentioned running roving at a position upstream of the corresponding draft part, the operation for exchanging the almost exhausted roving bobbin for the full packaged roving bobbin is then carried out. Thereafter, the roving bobbin exchanging operation is carried out for other pairs of almost exhausted roving bobbins suspended by a front bobbin hanger or a back bobbin hanger, facing each other, of a spinning frame, as a unit operation and the unit operation is successively carried out along the creel from one end to the other of the spinning frame.

Because the above-mentioned two pairs of pegs are provided with different working functions, the utilization of such two pairs of pegs causes the creation of a complicated construction of the roving bobbin exchanging apparatus. Moreover, if it is desired to carry out a combined operation of the above-mentioned roving bobbin exchanging operation with an automatic roving piecing operation, the construction of the apparatus for carrying out such a combined operation becomes more complicated so that the practice of such a combined operation becomes impossible.

SUMMARY OF THE INVENTION

It is an object of the present invention to provide a roving bobbin exchanging method solving the problems of the prior art.

It is an additional object to provide a method for carrying out the roving bobbin exchanging operation with a roving-piecing operation.

It is a further object to provide an apparatus for carrying out the above roving bobbin exchanging method and to provide a roving bobbin exchanging apparatus which can be incorporated with a roving-piecing apparatus.

To carry out the above roving bobbin exchanging method according to the present invention, a pair of pegs is utilized.

In this method, a pair of bobbin hangers, not having roving bobbins suspended therefrom, is previously prepared on the bobbin carrier at a position immediately upstream and outside of a group of bobbin hangers having full packaged roving bobbins suspended therefrom, for supplying such roving bobbins to a creel of a conventional ring spinning frame provided with a supply rail for the above-mentioned bobbin carrier. In this specification, such a prepared bobbin hanger not having a roving bobbin suspended therefrom is hereafter referred to as an auxiliary bobbin hanger. A first pair of almost exhausted roving bobbins, located at a position most upstream of the creel, one bobbin suspended by a front bobbin hanger and the other by a back bobbin hanger, facing each other in the creel, is transferred to the above two pegs. Thereafter, these two bobbins are transferred to the above two empty bobbin hangers of the supply rail by displacing these pegs to positions immediately below the respective auxiliary bobbin hangers. Then, the pegs are displaced upward to transfer these almost exhausted roving bobbins to the respective auxiliary bobbin hangers. During this transferring operation of exhausted roving bobbins from the bobbin hangers of the creel to auxiliary bobbin hangers of the bobbin carrier on the supply rail, the axial distance between the front bobbin hanger and back bobbin hanger, facing each other in the creel, is changed to the axial distance between these two auxiliary bobbin hangers.

After the above operation, the two pegs are displaced to positions immediately below the corresponding full packaged roving bobbins suspended by two adjacent bobbin hangers of the supply rail, facing the pair of bobbin hangers from which the almost exhausted roving bobbins have been taken. Such bobbin hangers are hereinafter referred to as empty bobbin hangers. During this operation, the axial distance between these pegs does not have to be changed.

After transfer, these full packaged roving bobbins are carried to the positions immediately below the corresponding empty bobbin hangers mentioned above. During this displacing operation of the full packaged roving bobbins toward the position right below the above-mentioned bobbin hangers of the creel, the axial distance between these pegs is changed to a distance identical to the axial distance between the empty bobbin hangers facing each other in the creel. Therefore, by displacing these pegs upward, the full packaged roving bobbins are caught by the empty bobbin hangers. Then, by displacing these pegs downwards, the transfer operation of these full packaged roving bobbins to the pair of empty bobbin hangers of the creel is completed.

According to this first unit operation for exchanging roving bobbins, a fresh pair of empty bobbin hangers is created in the bobbin carrier positioned at the supply position on the supply rail, at the adjacent downstream position facing the first pair of bobbin hanger of the creel, to which the first transfer operation of almost exhausted roving bobbins was applied. Accordingly, when the second unit operation for exchanging roving bobbins is carried out for the next pair of almost exhausted roving bobbins suspended by the next pair of bobbin hangers in the creel, the above-mentioned fresh empty bobbins are utilized to receive the almost exhausted roving bobbins carried by the above-mentioned pegs as one step of the second unit operation. The third unit operation and the fourth unit operation, etc., are carried out successively, as mentioned above, along the creel of the spinning frame. When the last unit operation is carried out, two empty bobbin hangers are created at the downstream end of the grouped bobbin hangers of the bobbin carrier on the supply rail.

Since the roving bobbin exchange apparatus according to the present invention has an extremely simplified construction, compared with the above-mentioned prior arts, and a very functional design, therefore, it is quite clear that the above-mentioned roving bobbin exchanging method is a method characterized by a high working efficiency which is superior to that of the known prior arts.

As a modification of the above method, it is also possible to temporarily hold a pair of almost exhausted roving bobbins, outside the bobbin carrier, before creating the above-mentioned empty bobbin hangers on the supply rail in the first unit operation. In this case, the temporarily held exhausted roving bobbins, created in the first unit operation, are transferred to the empty bobbin hangers created by the last unit operation.

To carry out the above method of the present invention, the apparatus for exchanging roving bobbins according to the present invention is provided with a unique peg unit comprising a pair of pegs, and a telescopic mechanism mounting those pegs in a condition such that the axial distance therebetween can be changed between a distance b, which is an axial distance between a front bobbin hanger and a back bobbin hanger facing each other on the creel, and a distance a, which is an axial distance between two adjacent bobbin hangers of the supply rail. It is also necessary to position the pegs immediately below the corresponding bobbin hangers of the creel and the supply rail. For this purpose, beside the above-mentioned unique peg unit, a mechanism for lifting this peg unit and a mechanism for displacing this peg unit are provided laterally.

By actuating this telescopic mechanism, the axial distance can be changed between a first distance identical to an axial distance between a front bobbin hanger and a back bobbin hanger, facing each other in the creel, and a second distance identical to the axial distance between two adjacent bobbin hangers of the supply rail.

For each peg of the peg unit to catch a roving bobbin from the corresponding bobbin hanger of the creel, or from the corresponding bobbin hanger of the supply rail, or transfer a roving bobbin to the bobbin hanger, it is necessary to position the peg immediately below the bobbin hanger. For this purpose, beside the above-mentioned unique peg unit, a mechanism for lifting this peg unit and a mechanism for turning this peg unit about a supporting axis of this peg unit are also included. These mechanisms carry out the unit roving bobbin exchanging operation.

In the above-mentioned roving bobbin exchanging apparatus according to the present invention, a minor modification of the apparatus to carry out the above-mentioned roving bobbin exchanging operation without utilizing the auxiliary bobbin hanger is disclosed. Such modification is a utilization of bobbin holders, which is disposed on the roving bobbin changing apparatus. Because the design of the construction of this roving bobbin exchanging apparatus is simple and functional, in comparison with the known prior arts, so that it is possible to dispose bobbin holder(s) on the apparatus. By applying such a temporarily holding system, the roving bobbin exchanging method of the present invention, particularly in the case for applying this method to so-called long spinning frame, can be more effectively carried out.

This apparatus is also provided with a mechanism for displacing this apparatus intermittently, but successively, from one side end of the creel to the other such that the apparatus is stopped at a position in front of each pair of almost exhausted roving bobbins of the creel. After completion of the unit operation for exchanging roving bobbins, the apparatus is displaced to the next downstream position.

DESCRIPTION OF THE PREFERRED EMBODIMENTS

A detailed explanation of the present invention is hereinafter explained with reference to the attached drawings. In the following explanation, the present invention is applied to a conventional ring spinning frame provided with identical spinning mechanisms at two sides with respect to the longitudinal direction of the machine frame. To simplify the explanation, an application of the present invention to the spinning mechanism mounted on one side of the spinning frame only is explained.

In a roving bobbin exchanging method and apparatus of a first embodiment of the present invention, it is sufficient to utilize a single supply rail extended in front of a spinning frame.

Figure 1:
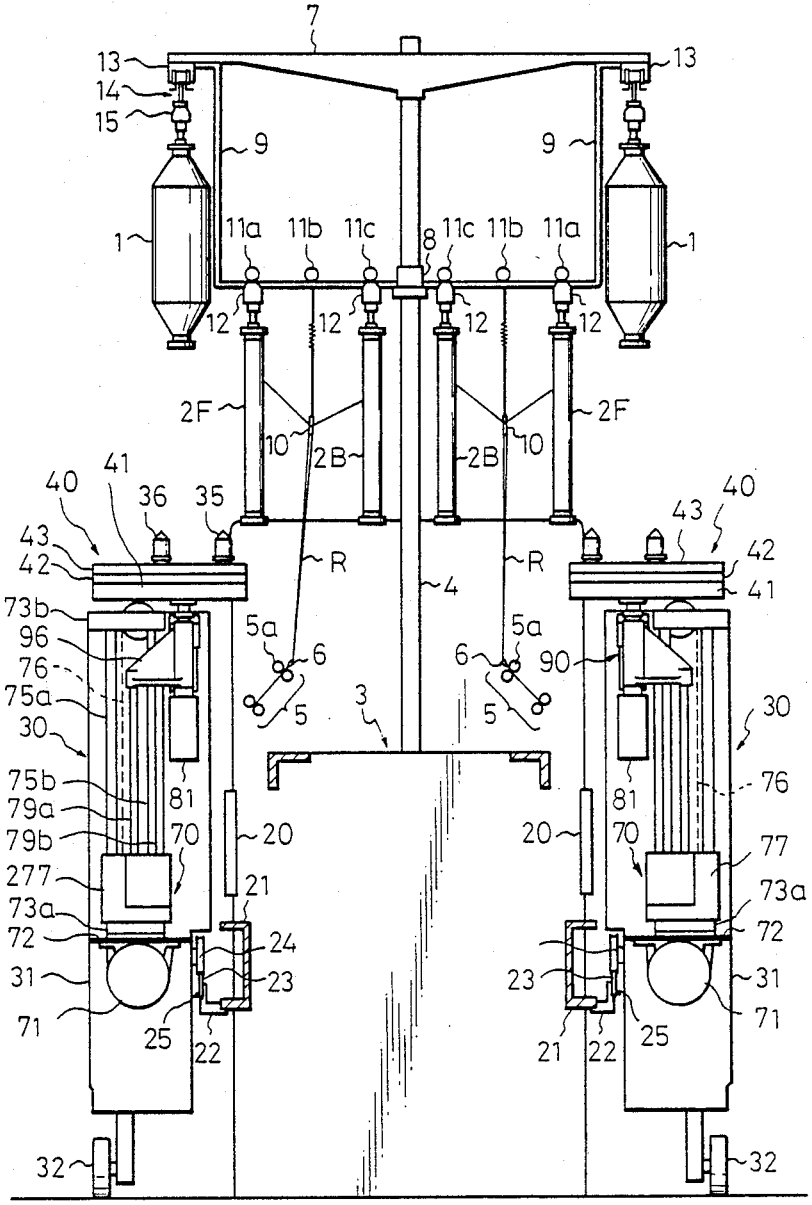
FIG. 1 is a side elevation of a spinning frame to which a pair of roving bobbin exchanging apparatuses of a first embodiment according to the present invention are mounted.
Figure 9:
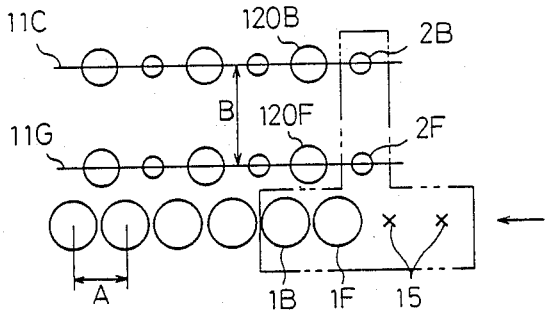
FIG. 9 is a schematic plan view showing the positional relationship between the apparatus shown in FIG. 1 and roving bobbins on the creel and supply rail of a spinning frame, when carrying out a method of a first embodiment according to the present invention.
Figure 10A:
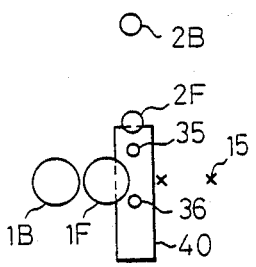
FIGS. 10A to 10H are diagrammatic illustrations indicating the steps of a roving bobbin exchanging operation to be executed by the method and apparatus in the first embodiment.
Figure 10B:
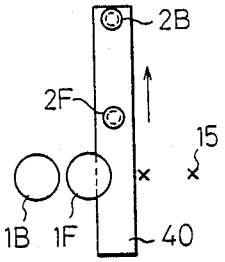
Figure 10C:
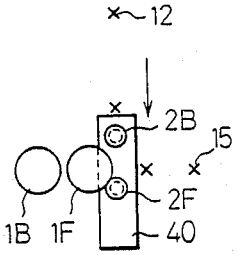
Figure 10D:
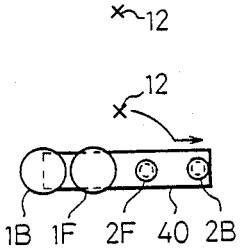
Figure 10E:
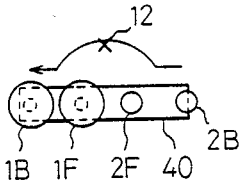
Figure 10F:
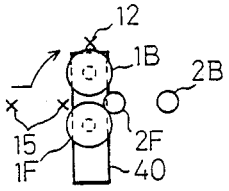
Figure 10G:
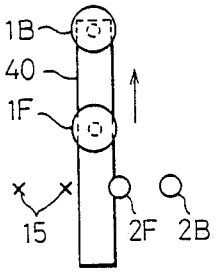
Figure 10H:
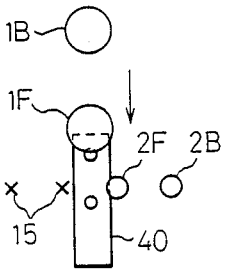

Referring to FIG. 1, creel pillars 4 are disposed perpendicularly on the frame 3 of a spinning frame at appropriate intervals along the longitudinal center line of the frame 3. A supply rail 13 is held so as to extend along the longitudinal direction of the frame 3, on the free ends of rail brackets 7 attached to the upper ends of the creel pillars 4. The supply rail 13 is a hollow beam member having a substantially U-shaped cross-section with an elongated opening along the lower side thereof. A bobbin carriage 14 is displaceably engaged in the elongated opening for travel along the supply rail 13. The bobbin carriage 14 carries bobbin hangers arranged with an identical axial distance "a" which is smaller than the axial distance "b" between a front bobbin hanger 12 and a back bobbin hanger 12, facing each other in the creel. The number of bobbin hangers carried on the bobbin carriage 14 is greater by two than the number (n) of the front or back bobbin hangers in the front row of the creel; that is, this number equals to (n+2). Before starting the roving bobbin exchanging operation, a fixed number of full packaged roving bobbins 1 corresponding to the number n of the front bobbin hangers 12 in the creel are hung on the bobbin carrier 14. The bobbin carrier 14 is stopped to satisfy a condition that a center of the intervals between the alignment of two auxiliary bobbin hangers and the next two bobbin hangers having full packaged roving bobbins suspended therefrom faces the alignment of the first pair of a front bobbin hanger and a back bobbin hanger, facing each other on the creel, as shown in FIG. 9. On the other hand, three supporting pipes 11*a*, 11*b*, and 11*c* are disposed on L-shaped supporting bars 9, each having one end connected to the corresponding free end of the rail bracket 7 and the other end connected to a supporting bracket 8 secured to the creel pillar 4 at a position above the middle part thereof. The front and back bobbin hangers 12 for suspending roving bobbins are arranged at predetermined intervals on the supporting pipes 11*a* and 11*c*, and roving guides 10 are arranged on the supporting pipe 11*b*. To carry out the roving bobbin exchanging operation in the first embodiment of the present invention, at the start of the spinning operation, roving bobbins having two different sizes, i.e,. a half-exhausted condition, hereinafter referred to as a half-exhausted roving bobbin, and a full packaged condition, hereinafter referred to as full packaged roving bobbin, are suspended alternately by pairs of bobbin hangers 12 facing each other in the creel along the longitudinal direction of the spinning frame, with regard to each side of the spinning frame. When the above-mentioned half-exhausted roving bobbins become almost exhausted or exhausted, each pair of these roving bobbins 2F, 2B, facing each other is exchanged for a pair of full packaged roving bobbins 1, which are adjacently suspended by two bobbin hangers 15 supported by the bobbin carrier 14 of the supply rail 13, simultaneously, pair by pair along the row of spindles. In FIG. 9, the almost exhausted or exhausted roving bobbins suspended by the bobbin hangers 15 of the front row are referred to as 2F, and those of the back row as 2B. In the following description, the above-mentioned exhausted or almost exhausted roving bobbins are referred to as "exhausted roving bobbins", to simplify the description, unless otherwise specified.

Figure 2:
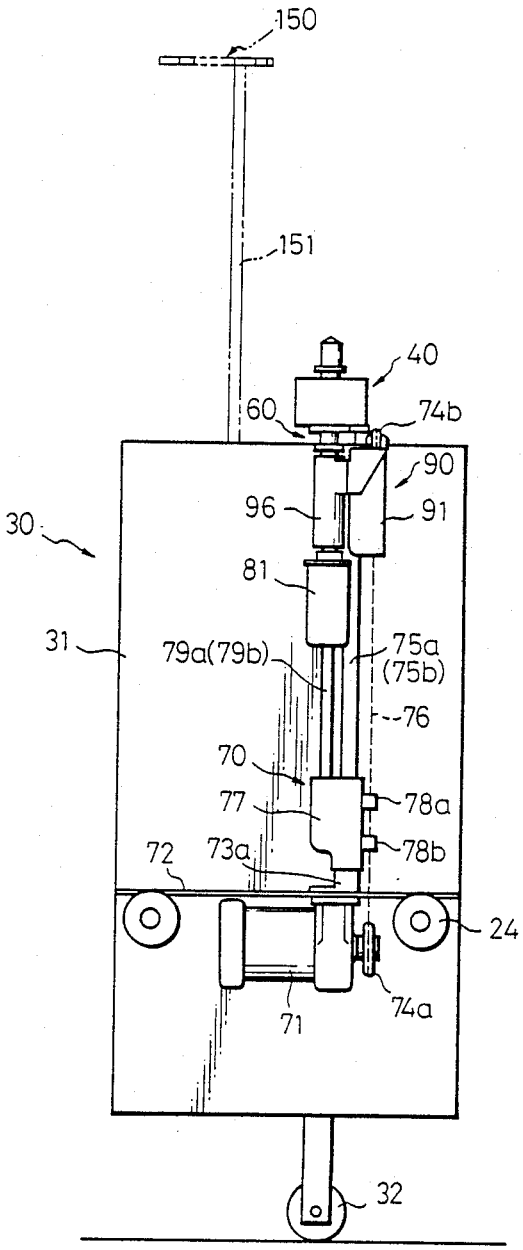
FIG. 2 is a schematic plan view of the roving apparatus shown in FIG. 1.

The roving bobbin exchanging method in accordance with the present invention employs a roving bobbin exchanging apparatus 30 which is capable of travelling along the front side of the spinning frame, namely, along the alignment of spindles 20. The roving bobbin exchanging apparatus 30, applied to the first embodiment, is provided with a body 31 with a wheel 32 mounted at the bottom thereof and guide rollers 24 on the side thereof facing the spinning frame, as shown in FIGS. 1 and 2. The body 31 of the roving bobbin exchanging apparatus 30 is further provided with a drive motor (not shown) to drive the body 31 and displace the apparatus 30 per se along the longitudinal direction of the spinning frame and a scroll cam cooperating with the drive motor. A guide rail 23 is supported on brackets 22 secured to a spindle rail 21 of the spinning frame, and a plurality of guide pins 25 are studded securely in the outer surface of the guide rail 23 at regular intervals corresponding to the pitch between two adjacent bobbin hangers 12 along the longitudinal direction the spinning frame. The guide rollers 24 roll on the guide rail 23 and the scroll cam engages the guide pins 25. Thus, when the scroll cam is rotated, the roving bobbin exchanging apparatus 30 moves along the row of the spindles of the spinning frame. The roving bobbin exchanging apparatus 30 can be stopped intermittently at predetermined positions to carry out the roving bobbin exchanging operation.

Figure 3:
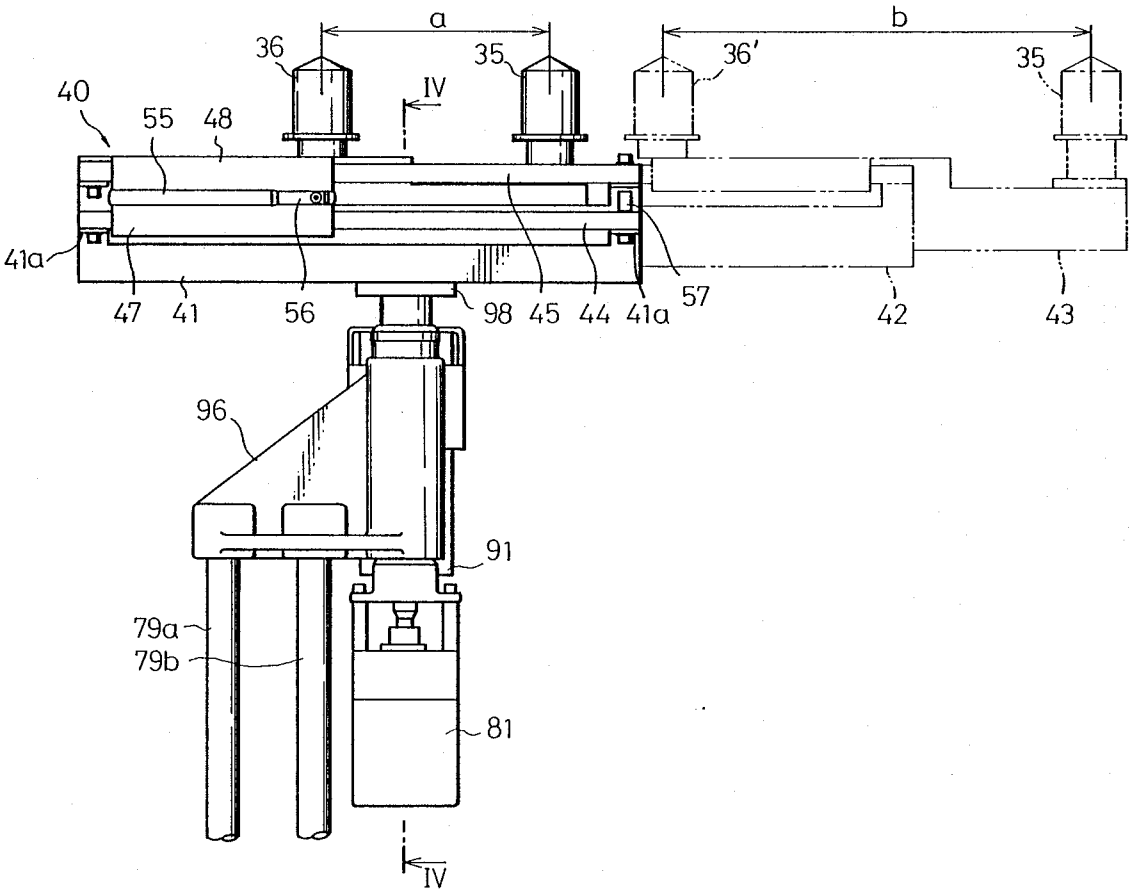
FIG. 3 is a general front elevation of a peg unit in the apparatus shown in FIG. 1.

The main constitution of the roving bobbin exchanging apparatus 30 will be explained in more detail hereinafter. The roving bobbin exchanging apparatus 30 is equipped with functional devices for carrying out the roving bobbin exchanging operation in a predetermined sequence, whereby each pair of exhausted roving bobbins 2F, 2B facing each other in the creel are exchanged for a pair of full packaged roving bobbins 1, which are adjacently suspended by the bobbin hangers 15 supported by the bobbin carrier 14 of the supply rail 13, simultaneously, pair by pair along the row of spindles, and a drive mechanism for driving those functional devices. Referring to FIGS. 1, 2, and 3, the roving bobbin exchanging apparatus 30 is provided with a peg unit 40 which comprises a pair of pegs 35, 36, a telescopic mechanism 60 whereon the above-mentioned two pegs are mounted such that the axial distance therebetween can be changed between a distance b, which is an axial distance between a front bobbin hanger 12 and a back bobbin hanger 12, facing each other on the creel of the spinning frame, and a distance a, which is an axial distance between two adjacent bobbin hangers 15 on the bobbin carrier 14 on the supply rail 13, a lifting mechanism 70 which is capable of lifting the peg unit 40, and a displacing device 90 which shifts the telescopic mechanism 60 of the peg unit 40 between a position where the pair of pegs 35, 36 is positioned immediately below the full packaged roving bobbins suspended by the corresponding bobbin hangers 15 of the supply rail 13 and a position where the pair of pegs 35, 36 is positioned immediately below the bobbin hangers 15 without roving bobbins on the bobbin carrier 14 on the supply rail 13, after the axial distance between two pegs 35, 36 has been changed to coincide with the axial distance "a" between the corresponding two bobbin hangers 15.

As illustrated in FIGS. 1 and 2, the lifting device 70 is mounted on a supporting plate 72 provided within the body 31 of the roving bobbin exchanging apparatus 30. A first motor 71 for the lifting device 70 is secured to the lower side of the supporting plate 72, a lower pillar bracket **73*a* is secured to the upper surface of the supporting plate 72, an upper pillar bracket 73*b* is secured to the upper plate of the body 31, two pillars 75*a* and 75*b* are extended vertically between the lower pillar bracket 73*a* and the upper pillar bracket 73*b*, and a slider 77 is mounted on the two pillars 75*a* and 75*b* for sliding movement along the two pillars 75*a* and 75*b*. A chain 76 is extended between a sprocket wheel 74*a* secured to the output shaft of the first motor 71 and a sprocket wheel 74*b* rotatably mounted on a pin secured to the upper pillar bracket 73*b*. The chain 76 is securedly connected to the slider 77 by chain holders 78*a* and 78*b*. Two supporting rods 79*a* and 79*b* are secured to the slider 77 in the vertical posture, and a supporting member 96 for supporting the telescopic mechanism 60 of the peg unit 40 is secured to the respective upper ends of the supporting rods 79*a* and 79*b*. Accordingly, when the first motor 71 is actuated, the slider 77 is displaced vertically by the chain 76, whereby the peg unit supporting member 96 supporting the telescopic mechanism 60 of the peg unit 40** can be moved vertically.

Figure 4:
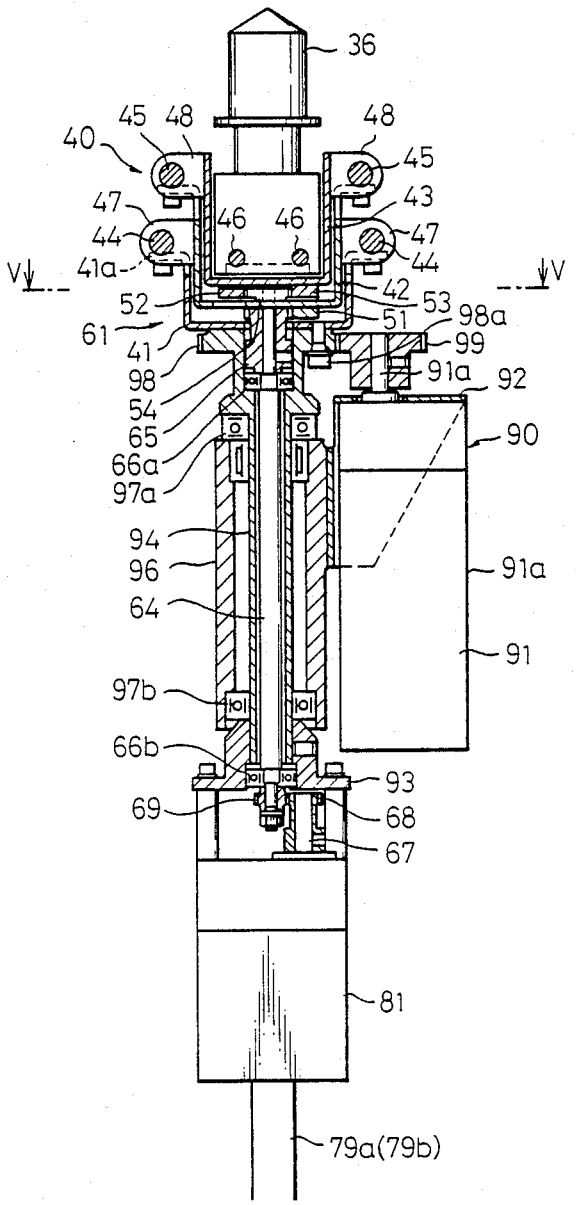
FIG. 4 is a partly sectional front elevation taken along a line IV—IV in FIG. 3, which illustrates a mechanism for actuating the peg unit of the apparatus shown in FIG. 1.

Referring to FIGS. 3 and 4, a hollow shaft 94 is journaled in bearings **97*a* and 97*b* on the supporting member 96, and a motor 91 of a displacing device 90 is secured to the supporting member 96. A driving shaft 64 extended through the hollow shaft 94 has an upper end which is rotatably supported in a bearing 66*a* on the hollow shaft 94 and a lower end which is rotatably supported in a bearing 66*b* on a lower bracket 93 secured to the lower end of the hollow shaft 94. A second motor 81 for the mechanism for actuating the telescopic mechanism 60 is suspended rigidly from the lower bracket 93 by bolts. A driving gear 68 secured to an output shaft 67 of the second motor 81 and a gear 69 secured to the lower end of the driving shaft 64 are meshed, and a gear 65, which actuates the telescopic mechanism 60, is secured to the upper end of the driving shaft 64**.

Figure 5:
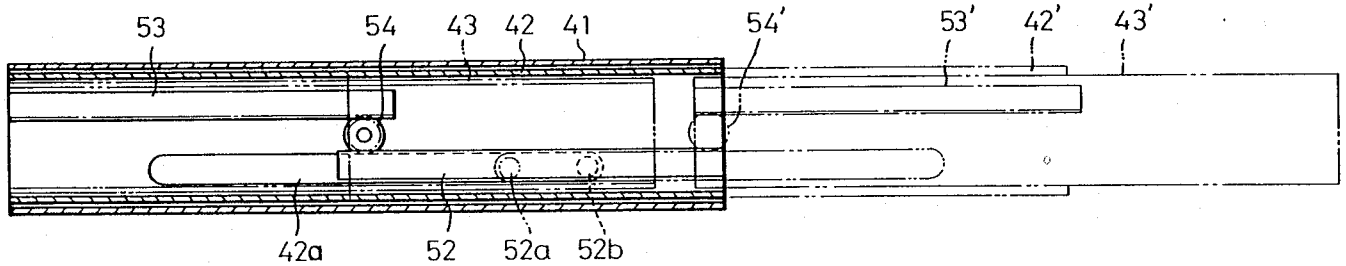
FIG. 5 is a schematic sectional view showing a mechanism for moving a second slider relative to a first slider at a speed twice that of the first slider, in the peg unit shown, taken along a line V—V in FIG. 4.
Figure 6A:
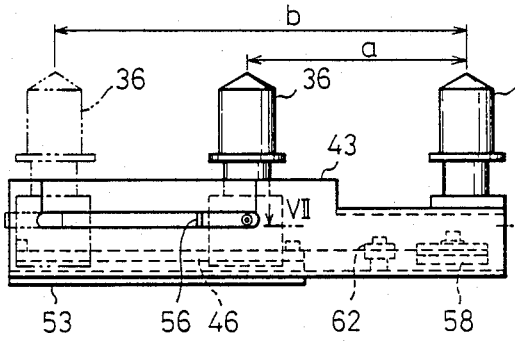
FIGS. 6(A) and 6(B) are a front elevation and a side elevation, respectively, generally showing the second slider together with the first slider.
Figure 6B:
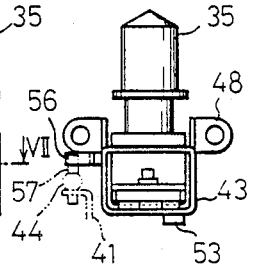
Figure 7A:
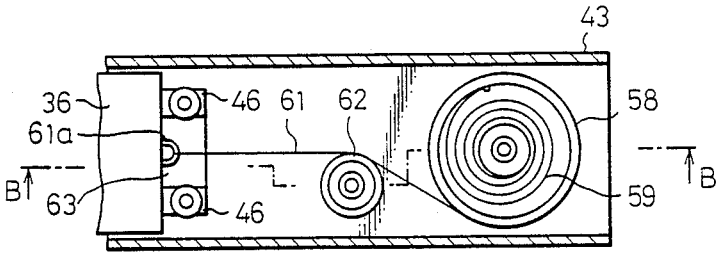
FIGS. 7(A) and 7(B) are a plan view and a side elevation, respectively, showing a mechanism for urging the second peg provided on the second slider toward the first peg provided on the second slider.
Figure 7B:
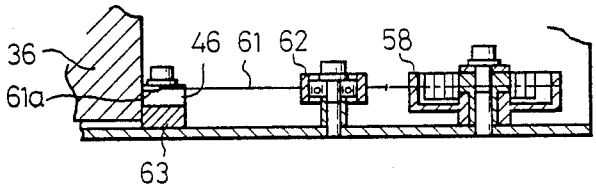

A gear 98 having a large diameter is formed integrally with the upper end portion of the hollow shaft 94, and a slide base 41 is fastened with bolt **98*a* to the gear 98. As shown in FIGS. 3 and 4, the telescopic mechanism 60 of the peg unit 40 is provided with a slide base 41 secured to the hollow shaft 94, a first slider 42 which slides on the slide base 41, and a second slider 43 which slides on the first slider 42. The slide base 41 has a U-shaped cross-section, and the opposite longitudinal ends (the right and left ends as shown in FIG. 3) of the slide base 41 are bent outward to form lugs 41*a*. First rods 44 are fastened to the upper surfaces of the lugs 41*a* with bolts, and one of the bolts fastening the first rods 44 to the lugs 41*a* projects upward to serve also as a stopper pin 57. A second rack 52 is secured through collars 52*a* and 52*b* (FIG. 5) to the upper surface of the slide base 41. The first slider 42, as well as the slide base 41, has a U-shaped cross-section, and second rods 45 are fastened to lugs formed in the first slider 42 at the opposite longitudinal ends thereof with bolts. Bearing parts 47 projecting from the opposite sides of the first slider 41 are slidably engaged with the first rods 44 therethrough. A first rack 51 engaging the gear 65 of the driving shaft is fastened to the lower surface of the first slider 42, and a pinion 54 is supported rotatably on the upper surface of the first slider 42. The pinion 54 engages with the second rack 52 and a third rack 53 secured to the lower surface of the second slider 43. An elongated slot 42*a* is formed in the bottom wall of the first slider 42 to enable the second rack 52 to move without interfering with the first slider 42. The second slider 43 also has a U-shaped cross-section. Bearing parts 48 project from the opposite sides of the second slider 43 slidably engaged with the second rods 45 therethrough. The peg 35 is rigidly mounted on the front end of the second slider 43, and the peg 36 is mounted slidably on a third rod 46 secured to the upper surface of the bottom wall of the second slider 43. As shown in FIGS. 6, 7(A), and 7(B), a wire drum 58 disposed within the second slider 43 is urged in a winding direction to wind a wire 61 by a spiral spring 59. The wire 61 is extended via a guide roller 62. One free end thereof is connected to a hook 61***a* secured to the front side of the peg 36. Accordingly, the peg 36, which is slidable along the third rod 46, is pulled forward and the sliding motion of the peg 36 is stopped by contact with a stopper 63 secured to the second slider 43, which functions as a seat for the third rod 46, so that the position of the peg 36 is regulated. In this condition, the distance between the pegs 35 and 36 is identical to the distance (a) between the adjacent two bobbin hangers 15 on the supply rail 13. An engaging member 56 is secured to the side surface of the peg 36 so as to project into a space between a bearing part 47 of the first slider 42 and a bearing part 48 of the second slider 43.

Thus, the first slider 42 and second slider 43 of the telescopic mechanism 60 of the peg unit 40 can be advanced and retracted telescopically. That is, when the second motor 81 is actuated, the rotative power of the second motor 81 is transmitted through the gears 68 and 69 to the driving shaft 64 to rotate the driving gear 65. Consequently, the first slider 42 is advanced by sliding along the slide base 41, and the pinion 54 supported on the first slider 42 engaging the second rack 52 is caused to rotate while moving together with the first slider 42. Since the pinion 54 rotates about the center thereof while moving linearly together with the first slider 42, the circumferential speed of the pinion 54 is twice the linear speed of the first slider 42, and since the third rack 53 secured to the second slider 43 engages the pinion 54, the second slider 43 slides forward on the first slider 42 at a linear speed twice the linear speed of the first slider 42. While the first slider 42 and the second slider 43 are thus advanced, the engaging member 56 secured to the peg 36 comes into contact with the stopper pin 57 so that a further advance of the peg 36 is stopped. The first slider 42 and the second slider 43 are advanced further while the peg 36 moves backward relative to the second slider 43 against the resilient force of the spiral spring 58. When the first slider 42 and the second slider 43 arrive, respectively, at the front end of their forward motion, as indicated by imaginary lines in FIGS. 3 and 5, the distance (b) between the pegs 35 and 36 becomes equal to the distance (B) between a front bobbin hanger 2F and a back bobbin hanger 2B facing this front bobbin hanger 2F, on the creel of the spinning frame (FIG. 9). During retraction, the peg 36 comes into contact with the stopper 63 of the second slider 43 and, thereafter, the first slider 42 and the second slider 43 retract, respectively, to standing positions as indicated by lines in FIG. 3, while the pegs 35 and 36 are maintained with the distance (a) therebetween.

Figure 8A:
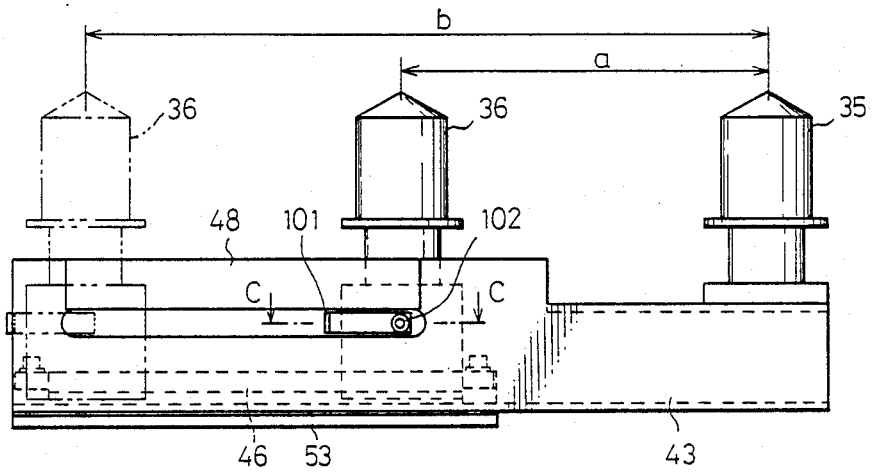
FIG. 8A is a front elevation showing the general construction of a modified embodiment of a peg unit having a sliding mechanism provided a slider.
Figure 8B:
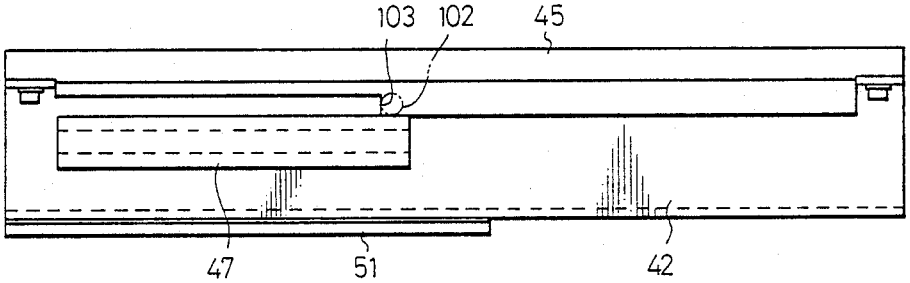
FIG. 8B is a front elevation of the sliding mechanism shown in FIG. 8A, which indicates the relationship between a collar and a first slider in the peg unit shown in FIG. 8A.
Figure 8C:
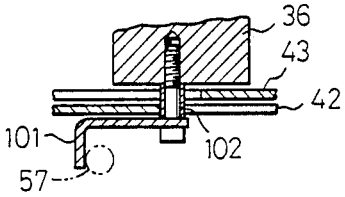
FIG. 8C is a fragmentary sectional view taken along a line C—C in FIG. 8A, which indicates the relationship between a collar and hook and a stopper pin.

The control of the relative movement of the peg 36 to the peg 35 so as to change the axial distance between the pegs 35 and 36, explained with reference to the embodiment shown in FIGS. 3, 6A, 6B, 7A, and 7B can be carried out by the following modification thereof as shown in FIGS. 8A to 8C. An engaging member 101 is bolted through a collar 102 to the side surface of a base of the peg 36 as shown in FIGS. 8A to 8C. As shown in FIG. 8B, a stopping surface 103 with which the collar 102 is brought into contact is formed above the bearing part 47 on one of the side walls of the first slider 42. Then, while the first slider 42 and the second slider 43 are advanced telescopically, the engaging member 101 comes into contact with the stopper pin 57 to control the motion of the peg 36 and, thereafter, the distance between the pegs 35 and 36 becomes equal to the axial distance (b) at the forward end of the advance movement of the first slider 42 and the second slider 43. During retraction of these sliders, similar to the mode during the advance thereof, since the second slider 43 is retracted at a linear speed twice that of the first slider 42, the collar 102 secured to the peg 36 comes into contact with the stopping surface 103 of the fist slider 42, so that the distance between the pegs 35 and 36 is gradually decreased in accordance with the rearward motion of the first slider 42 and the second slider 43, and the axial distance between the pegs 35 and 36 becomes equal to the distance (a) upon the arrival of the first slider 42 and the second slider 43 at the respective ends of their rearward displacing motion, which are their standby positions, respectively.

Referring to FIG. 4, the displacing device 90 utilized in this embodiment is provided with a gear 99 engaging the large gear 98 secured to the hollow shaft 94 and keyed to an output shaft 91*a* of the motor 91 (hereinafter referred to as "third motor"), rigidly mounted on the supporting member 96, for turning the telescopic mechanism 60 of the peg unit 40. The output shaft 91*a* of the third motor 91 is rotated in the normal direction or in the reverse direction to turn the telescopic mechanism of the peg unit 40 together with the hollow shaft 94, so that the telescopic mechanism 60 of the peg unit 40 can be directed in desired directions.

The roving bobbin exchanging method carried out by the above-mentioned apparatus 30 will be described hereinafter with reference to schematic plan views shown in FIGS. 9 and 10(A) to 10(H).

As shown in FIG. 9, pairs of front and back half exhausted roving bobbins 120F and 120B and pairs of front and back exhausted roving bobbins 2F and 2B are suspended alternately on the bobbin hangers 12 on the creel of the spinning frame, while at least two auxiliary bobbin hangers and a plurality of pairs of two adjacent bobbin hangers 15 holding full packaged roving bobbins are carried by displacing the bobbin carrier 14 to the predetermined position on the supply rail facing the above-mentioned creel of the spinning frame. The number of such bobbin hangers holding full packaged roving bobbin is identical to half of the number of the above-mentioned pairs of bobbin hangers in the creel of one side in the spinning frame. The pair of full packaged roving bobbins suspended by each pair of two adjacent bobbin hangers on the supply rail 13 is hereinafter referred to as 1F and 1B, as shown in FIG. 9. The roving bobbin exchanging apparatus 30 traveling along the spinning frame from the direction of an arrow (FIG. 9) stops at a predetermined first position where the peg unit 40 faces the first pair of exhausted roving bobbins 2F and 2B (FIGS. 1 and 10(A)). The telescopic mechanism 60 is then actuated to advance the pegs 35 and 36 of the peg unit 40, whereby the axial distance between the pegs 35 and 36 increases in accordance with the forward motion of the pegs 35 and 36. Finally, the peg 35 reaches a position immediately below the exhausted roving bobbin 2B and the peg 36 reaches a position immediately below the exhausted roving bobbin 2F (FIG. 10(B)). Subsequently, the lifting mechanism 70 is actuated to raise the peg unit 40 to remove the exhausted roving bobbins 2F and 2B from the respective bobbin hangers 12 on the creel of the spinning frame, and the peg unit 40 is then lowered. Then, the pegs 35 and 36 are retracted to the respective standby positions in the telescopic mechanism 60 of the peg unit 40 (FIG. 10(C)). The distance between the pegs 35 and 36 decreases in accordance with the retracting motion of the pegs 35 and 36. Then, the displacing unit 90 is actuated to turn the telescopic mechanism 60 of the peg unit 40 by an angle of 90 so that the telescopic mechanism 60 of the peg unit 40 extends along the longitudinal direction of the supply rail 13, and at the same time, the pegs 35 and 36 are advanced slightly by the motion of the telescopic mechanism 60 to a position immediately below the empty bobbin hangers 15 (FIG. 10(D)). The distance between the pegs 35 and 36 remains unchanged, because the pegs 35 and 36 are advanced by only a small distance. Then, the peg unit 40 is raised by the lifting mechanism 70 so that the exhausted roving bobbins 2F and 2B supported on the pegs 35 and 36 are transferred to the corresponding empty bobbin hangers 15 of the supply rail 13, then the peg unit 40 is lowered. Then, the telescopic mechanism 60 is actuated so as to slightly retract the first and second sliders 42, 43 relative to the slide base and, at the same time, the peg unit 40 is turned counterclockwise by an angle of 180, as indicated by an arrow (FIG. 10(E)), by the displacing unit. The pegs 35 and 36 of the peg unit 40 are then displaced slightly forward to a position immediately below the corresponding full roving bobbins 1F and 1B, respectively by actuating the telescopic mechanism 60. Subsequently, the lifting mechanism 70 is actuated to raise the peg unit 40 to remove the full roving bobbins 1F and 1B from the respective bobbin hangers 15, and then the peg unit 40 is lowered in a condition such that the full roving bobbins 1F and 1B are supported by the corresponding pegs 35 and 36, respectively (FIG. 10(E)). The telescopic mechanism 60 is turned clockwise as indicated by an arrow by an angle of 90 after retracting the pegs 35 and 36 slightly (FIG. 10(F)), and then the pegs 35 and 36 are advanced by actuating telescopic mechanism 60 so that the axial distance therebetween is increased such that the full roving bobbins 2F and 2B come to positions immediately below the empty bobbin hangers 12 on the creel of the spinning frame from which the exhausted roving bobbins 2F and 2B have just been removed. The lifting mechanism 70 is actuated to raise the peg unit 40 toward the empty bobbin hangers 12, so that these full packaged roving bobbins are transferred to the corresponding bobbin hangers 12 (FIG. 10(G)). The peg unit 40 is then lowered by the motion of the lifting mechanism 70 and then retracted by actuating the telescopic mechanism so that the peg unit 40 is moved to the standby position thereof (FIG. 10(H)). The above-mentioned unit operation for carrying out the roving bobbin exchanging operation is stepwisely applied to the alternate pairs of bobbin hangers of the front and back row, suspending exhausted roving bobbins, wherein, in each pair, one of the exhausted roving bobbins is suspended by a front bobbin hanger and the other by a back bobbin hanger, in a facing condition, from one end of the spindle alignment to the other end, so that a series of roving bobbin exchanging operations, subjected to alternative pairs of bobbin hangers having exhausted roving bobbins suspended therefrom, is completed for one side of the spinning frame.

A second embodiment of the present invention will be described hereinafter. The roving bobbin exchanging apparatus in the second embodiment is applied to exchanging roving bobbins on a spinning frame provided with two supply rails extended in front of the front row of bobbin hangers.

In this embodiment, roving bobbins suspended by all bobbin hangers of the creel simultaneously become exhausted, so that the unit roving bobbin exchanging operation must be applied to all pairs of the front bobbin hanger and the back bobbin hanger, facing each other, on the creel of the ring spinning frame.

Therefore, in this embodiment, a pair of supply rails are arranged in parallel at a position in front of each spinning frame, instead of utilizing a single supply rail as in the first embodiment. Each bobbin carrier is provided with bobbin hangers having full packaged roving bobbins suspended therefrom, respectively, which number is same as the number of bobbin hangers of the front row in the creel, i.e., the number of bobbin hangers of the back row in the creel of the spinning frame, and is also provided with one bobbin hanger functioning as an auxiliary bobbin hanger. At the above-mentioned supply position of these bobbin carriers for carrying out the roving bobbin exchanging operation, the alignment of a bobbin hanger of the front bobbin carrier and the alignment of a bobbin hanger of the back bobbin carrier, facing each other, coincides to the alignment of a front bobbin hanger and a back bobbin hanger in the creel of the spinning frame. Therefore, the axial distance between two adjacent exhausted roving bobbins in the front row of the bobbin hanger alignment or in the back row of the bobbin hanger alignment is identical to the axial distance between two adjacent full packaged roving bobbins in the front supply rail or in the back supply rail. The first pair of exhausted roving bobbins 2B and 2F faces the pair of auxiliary bobbin hangers 15, which are facing each other, on the two rows of supply rails. When the roving bobbin exchanging operation is started, the roving bobbin exchanging apparatus 30, which is capable of traveling along the spinning frame, is first stopped at a position such that the pegs 35 and 36 of the peg unit 40 thereof are located at the working position of the apparatus in front of the first pair of bobbin hangers of the creel and then the first unit operation is carried out. Thereafter, the successive operation steps involved in the unit roving bobbin exchanging operation are carried out to the remained pairs of bobbin hangers of the creel. After completion of the above-mentioned first unit roving bobbin exchanging operation, the apparatus 30 is displaced to the next adjacent position to carry out the second unit operation, and such successive unit operations are carried out from the one end side of the spinning frame to the other end side thereof.

The roving bobbin exchanging apparatus 30 of the second embodiment is provided with a peg unit 40 comprising a pair of pegs 35, 36, a telescopic mechanism having a mechanism similar to the telescopic mechanism utilized in the first embodiment of the present invention, but the actuating mechanism of this telescopic mechanism is different from that of the first embodiment. Namely, in this second embodiment, the motor 81, referred to as the second motor in the first embodiment, is directly secured to the bottom surface of the slide base 41 of the telescopic mechanism 60, and the gear 65 (shown in FIG. 4) is secured to the motor shaft of the motor 81. Therefore, the telescopic mechanism 60 can be actuated only by the action of the motor 81 through the motor shaft thereof and the gear 65. The roving bobbin exchanging apparatus of this second embodiment is further provided with a device for lifting the telescopic mechanism 60 vertically, and a device for laterally displacing the telescopic mechanism between an alignment of a bobbin hanger of the front bobbin carrier and a bobbin hanger of the back bobbin carrier, facing each other, and the adjacent such alignment of bobbin hangers of two bobbin carries. The constitutional elements of the telescopic mechanism and the lifting device, however, are similar to those of the first embodiment, and thus a detailed explanation thereof is omitted. Since the construction and function of the displacing device 100 is unique, the construction and function are explained hereinafter.

Figure 11:
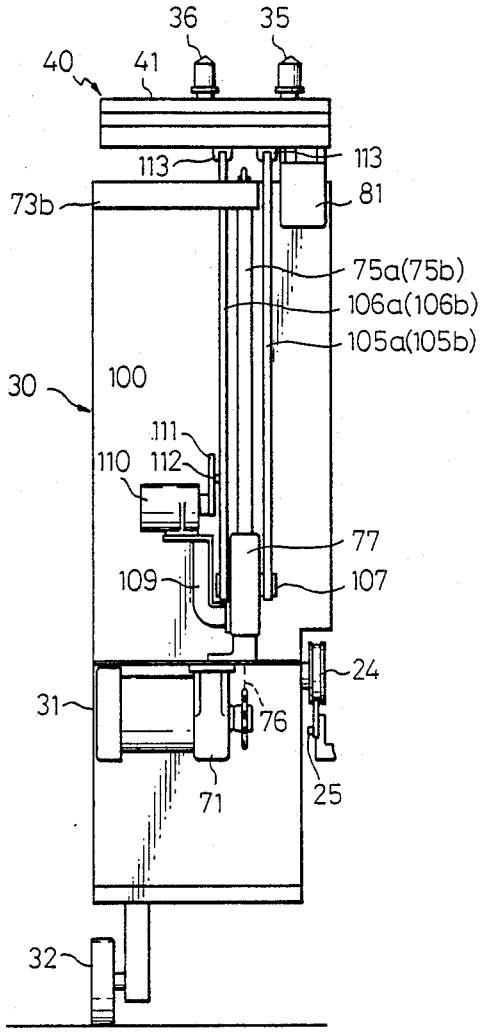
FIG. 11 is a longitudinal sectional view of an apparatus of a second embodiment according to the present invention.
Figure 12:
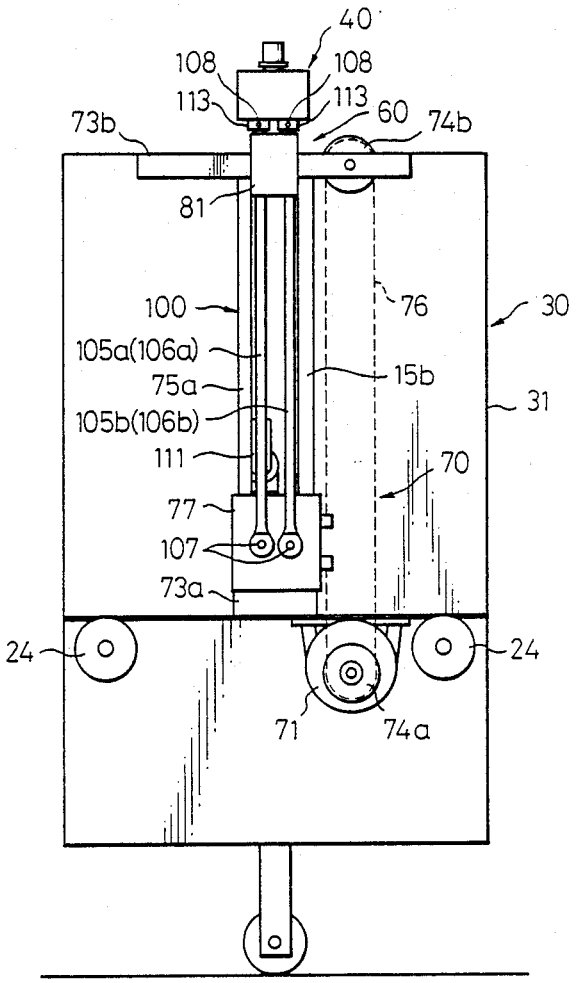
FIG. 12 is a schematic front elevation of the apparatus shown in FIG. 11.
Figure 13:
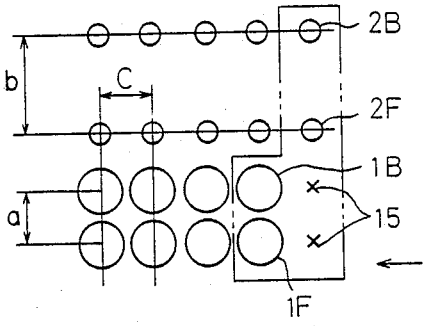
FIG. 13 is a schematic plan view showing the positional relationship between the apparatus shown in FIG. 11 and roving bobbins on the creel and supply rails of a spinning frame.

As shown in FIG. 11, in the peg unit 40, two pairs of connecting members 113 are secured to the lower surface of the bottom wall of the slide base 41 of the peg unit 40 at the front and back thereof, and pairs of supporting shafts 107 are rigidly mounted on the front and back surfaces of the slider 77 at the right and left sides thereof. Each of the supporting rods 105*a*, 105*b*, 106*a*, and 106*b* has an identical length and is turnably connected at both end portions thereof by the corresponding supporting shafts 107 and the pins 108 of the corresponding connecting member 113. Thus, the four supporting rods 105*a*, 105*b*, 106*a*, and 106*b*, the slide base 41, and the slider 77 constitute a pair of parallel linkages for supporting the peg unit 40 for swing motion in the longitudinal direction of the spinning frame. A fourth motor 110 for driving the displacing device is mounted on a motor base 109 secured to the back surface (the left surface as viewed in FIG. 11) of the slder 77. A swing lever 111 having a slot is secured to the output shaft of the fourth motor 110, and a pin 112 secured to the supporting rod 106*a* is received in the slot of the swing lever 111. The output shaft of the fourth motor 110 is rotated in the normal or reverse direction to swing the peg unit 40 within a predetermined range.

Figures 14A, 14B, 14C, 14D:
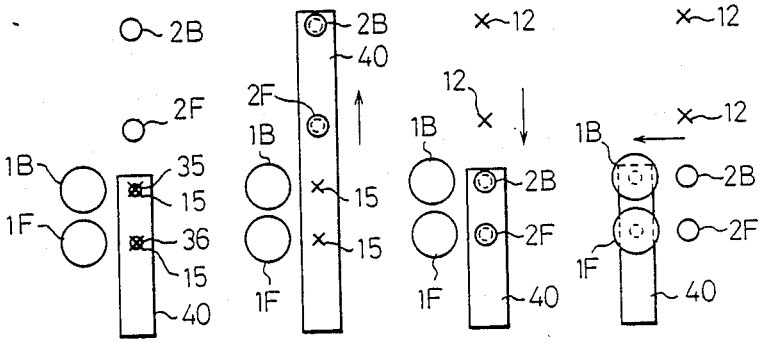
FIGS. 14A to 14G are diagrammatic illustrations indicating the steps of a roving bobbin exchanging operation to be executed by the method and apparatus of the second embodiment.
Figures 14E, 14F, 14G:
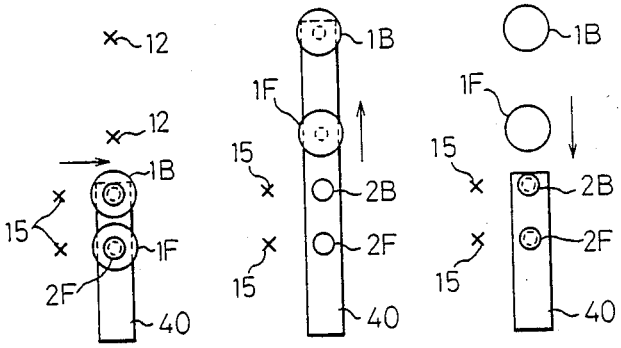

The roving bobbin exchanging procedures for the roving bobbin exchanging apparatus 30 in the second embodiment are similar to those carried out by the roving bobbin exchanging apparatus 30 in the first embodiment. In the roving bobbin exchanging operation of the roving bobbin exchanging apparatus 30 in the second embodiment, as described hereinbefore, the pegs 35 and 36 are stopped directly below the corresponding pair of bobbin hangers 15 on the supply rails (FIG. 14(A)), the peg unit is advanced to remove the exhausted roving bobbins 2F and 2B (FIG. 14(B)), the pegs 35 and 36 are returned to the standby positions, and then the exhausted roving bobbins are suspended by the empty bobbin hangers 15 on the supply rails (FIG. 14(C)). Then, the displacing device 100 swings the peg unit 40 to a position where the pegs 35 and 36 are located immediately below the full packaged roving bobbins 1F, 1B suspended by the corresponding bobbin hangers of the supply rails. Then the full packaged roving bobbins 1F and 1B are removed from these bobbin hangers of the supply rails (FIG. 14(D)), the peg unit 40 is returned to the standby position (FIG. 14(E)), the peg unit 40 is advanced to transfer the full packaged roving bobbins 1F and 1B on the bobbin hangers 12 from which the exhausted roving bobbins 2F and 2B have just been removed (FIG. 14(F)), and then the peg unit 40 is returned to the standby position (FIG. 14(G)), to complete one cycle of the roving bobbin exchanging operation. The roving bobbin exchanging apparatus 30 is moved intermittently along the longitudinal direction of the spinning frame by a step corresponding to the longitudinal axial intervals B, between adjacent two pairs of bobbin hangers on the creel of the spinning frame, which is half the step of the movement of the roving bobbin exchanging apparatus in the first embodiment, to repeat the cycle of roving bobbin exchanging operations sequentially.

Figure 15:
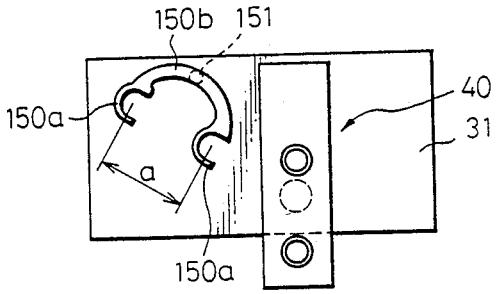
FIG. 15 is a schematic plan view of a bobbin supporting member utilized for a modified embodiment of the apparatus according to the present invention.

In the above-mentioned embodiments of the present invention, two auxiliary bobbin hangers must be prepared before transporting the bobbin carrier having full packaged roving bobbins suspended therefrom to the working position of the roving bobbin exchanging apparatus. As pointed out in the Description of the Related Art, for example, if the above-mentioned bobbin carriage utilized for the first embodiment of the present invention is utilized for changing the roving bobbins in a long spinning frame provided with double the number of spindles of a conventional spinning frame, modification of the first embodiment of the present invention must be considered. This is because, in this case, it is necessary to use two connected bobbin carriages for supplying full packaged roving bobbins to this long spinning frame. Therefore, a bobbin carriage provided with two auxiliary bobbin hangers not holding a roving bobbin at the middle portion thereof must be used. Accordingly, the above-mentioned roving bobbin exchanging apparatus disclosed as the first embodiment of the present invention cannot be used, particularly. To solve this problem, the following modification of the first embodiment was developed s explained hereinafter. That is, as shown by imaginary lines in FIG. 2, a pair of bobbin supporting members 150 is mounted vertically on the main body of the roving bobbin exchanging apparatus 30, so as to temporarily hold two full packaged roving bobbins (or a pair of front or back exhausted roving bobbins facing each other on the creel of the spinning frame) which are first exchanged, and then the roving bobbin exchanging operation is carried out in the same way as explained in the disclosure of the first embodiment. Further as the last operation, the two full packaged roving bobbins (or exhausted roving bobbins) which are held by the above-mentioned bobbin supporting members 150 are displaced to the last bobbin hangers 12, from which exhausted roving bobbins were taken-off, of the creel of the spinning frame respectively. In this case, for each unit of the bobbin carriage explained in the first embodiment of the present invention, it is necessary to omit the two bobbin hangers not holding empty roving bobbins. For example, in the above-mentioned first embodiment of the present invention, as shown by the imaginary line in FIG. 2 and as shown in FIG. 15, the bobbin supporting member 150 is secured to a pillar 151 rigidly mounted on the main body of the apparatus 30. This bobbin supporting member 150 and the pillar 151 are positioned so that they do not disturb the motion of the peg unit 40 mentioned in the disclosure of the first embodiment of the present invention. In this embodiment, the bobbin supporting member 150 is formed by a pair of U-shaped bobbin holding portions 150*a*, which open toward the turning center of the peg unit 40 with an intervening distance between their opening centers which is identical to the central distance between two adjacent bobbin hangers 15 of the supply rail 13, and by an arc-shaped portion which connects the above-mentioned bobbin holding portions 150*a*. Each flange of the roving bobbins can be engaged by the respective bobbin holding portions 150*a*. As the above-mentioned bobbin supporting member 150, a member such as a usual bobbin hanger of a member for gripping the roving bobbin can be utilized. In the above-mentioned second embodiment of the present invention, a bobbin supporting member such as the above-mentioned bobbin supporting member 150 can be also utilized if the bobbin exchanging apparatus is used for a long spinning frame.

In the above-mentioned embodiment, of course, the first motor 71 for vertically moving the peg unit 40 and the second motor 81 for displacing the peg unit 40 can be actuated simultaneously when vertically moving the peg unit 40 for receiving the exhausted roving bobbins 2F, 2B or the full packaged roving bobbins IF, 1B on the pegs 35 and 36, to reduce the time necessary for carrying out the roving bobbin exchanging operation. The lifting mechanism 70, the mechanism for actuating the telescopic mechanism 60, and the displacing devices 90 and 100 for moving the telescopic mechanism 60 of the peg unit 40 can be driven by hydraulic cylinders instead of motors. When pneumatic actuators are employed instead of motors, the roving bobbin exchanging apparatus can be designed with a compact construction when a rodless pneumatic cylinder is employed for driving the mechanism for actuating the telescopic mechanism 60, and a rotary actuator is employed for driving the displacing device 90. Furthermore, in the first embodiment, although the peg unit 40 is advanced slightly and retracted slightly to position the pegs 35, 36 of the peg unit 40 immediately below the empty bobbin hangers on the supply rail 13 and immediately below the full packaged roving bobbins on the supply rail 13, respectively, in order to position the roving bobbin exchanging apparatus as close as possible to the spinning frame, the operations for slightly advancing and slightly retracting the peg unit 40 can be omitted when the supply rail 13 and the roving bobbin exchanging apparatus 30 are moved away from the spinning frame so that the peg unit 40 will not interfere with the spinning frame when turning the peg unit 40 by an angle of 90 or 180, and the pegs 35 and 36 are positioned on the radius of rotation. It is not essential to coincide the axial alignment of a pair of front and back exhausted roving bobbins facing each other in the creel to the axial alignment of two full packaged roving bobbins suspended by a bobbin hanger of a front supply rail and a bobbin hanger of a back supply rail, facing each other. Although not shown in the drawings illustrating the above-mentioned embodiments, it is preferable to connect the pegs 35 and 36 with a compact motor or motors and to support the pegs 35 and 36 rotatably in order to take-up residual rovings of the exhausted roving bobbins in the roving bobbin exchanging operation after the completion of a roving piecing operation. For such a purpose, in the embodiments described herein, the slider base 41, the first slider 42, and the second slider 43 are formed as members each having a U-shaped cross-section, and the second slider 43 is adapted to accommodate a compact motor or motors. However, the slide base 41, the first slider 42, and the second slider 43 may be formed in the shape of a flat plate, and the slide base 41, the first slider 42, and the second slider 43 may be dovetailed in an ordinary fashion so as to be able to slide relative to each other, when only the roving exchanging function is required for the roving bobbin exchanging apparatus. Still further, the telescopic mechanism is not limited to that of the above-mentioned embodiment, but, since the overhang length becomes large when the sliders are moved up to the position where the pegs are immediately below the corresponding pair of front and back exhausted roving bobbins on the creel of the spinning frame, it is practically advantageous to utilize the first slider 42 and the second slider 43, and to make the second slider 43 advance and retract at a speed twice the speed of the first slider 42.

As apparent from the above-mentioned description, according to the present invention, since a peg unit including a pair of pegs mounted on sliders and capable of being displaced forward or backward by the telescopic mechanism in a condition such that one peg is secured to the corresponding slider while the other peg is slidable, and further, the distance between these pegs can be changed during the above-mentioned forward and backward displacing motion of the sliders so that the above-mentioned distance becomes identical to the axial distance between two bobbin hangers facing each other in the creel of the spinning frame, at the front terminal position of the forward motion of the slider, while the above-mentioned distance becomes identical to the distance between two adjacent bobbin hangers on the supply rail or two facing bobbin hangers on two supply rails at the back terminal position of the backward motion of slider, these pegs can be positioned immediately below the corresponding empty bobbin hangers of a supply rail or rails and positioned immediately below the corresponding full packaged roving bobbin of the supply rail or rails. Accordingly, the roving bobbin exchanging operation can be carried out in very preferable condition without trouble. Furthermore, since the component devices of the roving bobbin exchanging apparatus can be assembled in a small space, the roving bobbin exchanging apparatus can incorporate a roving piecing apparatus which is utilized for automatically piecing the roving from a full roving bobbin and the end portion of the roving from an exhausted roving bobbin while carrying out the normal spinning operation.

We claim:

1. A method for exchanging exhausted roving bobbins for full packaged roving bobbins applied to a conventional ring spinning frame provided with a creel in each side thereof, a plurality of bobbin hangers arranged on said creel in two rows so that each front bobbin hanger faces a corresponding back bobbin hanger, further provided with at least one supply rail extending in parallel to said creel at a position in front thereof, comprising a preparatory operation of carrying an alignment of a plurality of bobbin hangers holding full packaged roving bobbins to be exchanged for said exhausted roving bobbins, and two auxiliary bobbin hangers not holding roving bobbins to a position on said supply rail, in a condition such that said two auxiliary bobbin holders occupy a position upstream of said alignment of bobbin hangers, a first unit roving bobbin exchanging operation comprising a first step of taking-off a first pair of exhausted roving bobbins suspended from a first pair of front and back bobbin hangers, facing each other, on said creel, to which is to be applied a first unit operation in a series of unit roving bobbin exchanging operations, when said roving bobbin exchanging operation is required, a second step of displacing said exhausted roving bobbins taken from said first pair of front and back bobbin hangers of said creel, to respective positions directly below said auxiliary bobbin hangers, and then transferring said exhausted roving bobbins to the respective one of said auxiliary bobbin hangers, a third step of taking-off a pair of full packaged roving bobbins from a first pair of adjacent bobbin hangers located downstream of said auxiliary bobbin hangers on said supply rail, and then displacing said full packaged roving bobbins at the respective position directly below said first pair of front and back bobbin hangers, successive unit operations, stepwisely applied to the last pair of front and back bobbin hangers, facing each other on said creel, to which said unit roving bobbin exchanging operation is to be applied, comprising, a first step of taking-off a pair of exhausted roving bobbins suspended from a pair of front and back bobbin hangers, facing each other, on said creel, which follow a pair of front and back bobbin hangers on said creel, completing said unit roving bobbin exchanging operation by an immediately previous unit operation, a second step of displacing said exhausted roving bobbins taken from said pair of front and back bobbin hangers of said creel to the respective position directly below said bobbin hanger on said supply rail, from which a pair of full packaged roving bobbins were taken-off by the immediately previous unit roving bobbin exchanging operation, and then transferring said exhausted roving bobbins to the respective one of said bobbin hangers of said supply rail, a third step of taking-off a pair of full packaged roving bobbins from an adjacent pair of bobbin hangers located immediately downstream of said bobbin hangers, to which said exhausted roving bobbins were transferred by said second step, and then displacing said full packaged roving bobbins at the respective positions directly below said pair of front and back bobbin hangers on said creel, from which exhausted roving bobbins were taken by said first step operation, wherein, during each unit operation, an axial distance between two roving bobbins under operation is changed between an axial distance between said front bobbin hanger and said back bobbin hanger, facing each other, on said creel, and an axial distance between two adjacent bobbin hangers on said supply rail.

2. The method for exchanging exhausted roving bobbins for full packaged roving bobbins according to claim 1, wherein said auxiliary roving bobbins are replaced by a pair of bobbin holders for temporarily reserving said exhausted roving bobbins taken from said first pair of bobbin hangers on said creel, which are disposed at such positions beside said supply rail.

3. The method for exchanging exhausted roving bobbins for full packaged roving bobbins according to claim 1, wherein said auxiliary bobbin hangers and the alignment of bobbin hangers from which full packaged roving bobbins are suspended are carried to said supply position of said supply rail by transporting a carrier holding these bobbin hangers.

4. Apparatus for exchanging exhausted roving bobbins for full packaged roving bobbins, applied to a conventional ring spinning frame provided with a creel in each side thereof, a plurality of bobbin hangers being arranged on said creel in two rows so that each front bobbin hangers faces a corresponding back bobbin hanger, further provided with at least one supply rail extending in parallel to said creel at a position in front thereof comprising, a peg unit provided with a pair of pegs detachably holding roving bobbins respectively, a telescopic mechanism mounting those pegs in a condition capable of changing an axial distance therebetween from an axial distance between said front bobbin hanger and said back bobbin hanger facing each other on said creel (b) to an axial distance between two adjacent bobbin hangers on said supply rail (a), and vice versa, a lifting body supporting said peg unit means for displacing said peg unit to a position by which said pair of pegs take the respective positions directly below the corresponding pair of said front and back bobbin hangers, facing each other on said creel, and the respective positions directly below the corresponding adjacent two bobbin hangers on said supply rail, said displacing means being mounted on said lifting body, lifting means for vertically displacing said lifting body upwards and downwards to and from the corresponding pair of said front and back bobbin hangers, facing each other on said creel when said pegs of said peg unit take a position directly below said front and back bobbin hangers on said creel, respectively, and for vertically displacing said lifting body upwards and downwards to and from the corresponding adjacent two bobbin hangers on said supply rail when said pegs of said peg unit take a position right below said adjacent two bobbin hangers on said supply rail, respectively, means for controlling a sequential action composed of motions of said telescopic mechanism of said peg unit, said displacing means and said lifting means, a main body mounting said lifting body of said lifting means, a displacing mechanism for stepwisely displacing said body along said creel of said spinning frame and stopping said unit at the respective position for carrying out a unit roving bobbin exchanging operation applied to said pair of front and back bobbin hangers, facing each other on said creel, to which such a unit roving bobbin exchanging operation is to be applied.

5. The roving bobbin exchanging apparatus according to claim 4, further comprising a pair of bobbin holders disposed thereon, for temporarily holding two exhausted roving bobbins taken from said spinning frame in the first unit roving bobbin exchanging operation.

6. The roving bobbin exchanging apparatus according to claim 4, wherein said telescopic mechanism comprises a slide base, a first slider slidably mounted on said slide base along a longitudinal direction of said slide base, a second slider slidably mounted on said first slider along said first slider, means for restricting a possible change of an axial distance between said pegs of said peg unit during a relative displacing motion of said first and second sliders, means for actuating said relative displacing motion of said first and second slider to said slide base.

7. The roving bobbin exchanging apparatus according to claim 6, wherein said slide base of said telescopic mechanism is provided with an aperture located on a longitudinal centerline thereof, and said actuating means of said telescopic mechanism comprises a main shaft coaxially and rotatably passing through said aperture of said slide base, a first gear secured to said main shaft by a key at a position between said slide base and said first slide plate, means for driving said main shaft, a first rack rigidly formed on said first slider from a bottom side along a longitudinal direction of said first slider, and meshing with said first gear, a pinion gear rotatably mounted on said first slider at a position on a longitudinal center line of said first slider, a long groove formed on said first slider in parallel to said longitudinal center line of said first slider, a second rack extended along a longitudinal center line of said first slider and secured to said slide base through said long groove of said first slider, located at a position between said first slider and said second slider and meshing with said pinion gear, a third rack extended along a longitudinal center line of said first slider and secured to said second slider from a bottom side thereof, and meshing with said pinion gear.

8. The roving bobbin exchanging apparatus according to claim 7, wherein said means for driving said main shaft of said actuating means of said telescopic mechanism is a drive motor provided with a motor shaft which functions as said main shaft, said drive motor being secured to said slide base from a bottom side thereof.

9. The roving bobbin exchanging apparatus according to claim 7, wherein said means for driving said first gear of said actuating means of said telescopic mechanism, comprises a supporting body for supporting said peg units, rigidly mounted on said lifting body, a hollow shaft rotatably held by said supporting body and rigidly secured to said slide base from a bottom side thereof coaxially with said aperture of said slide base, a vertical shaft coaxially and rotatably disposed in said hollow shaft, said vertical shaft functioning as said main shaft of said actuating means of said telescopic mechanism, means for driving said vertical shaft, disposed at a bottom portion of said hollow shaft.

10. The roving bobbin exchanging apparatus according to claim 9, wherein said displacing means comprises an auxiliary body formed in said lifting body supporting said peg unit, a second motor rigidly mounted on said auxiliary body and provided with a motor shaft, a second gear secured to said motor shaft of said second motor, a gear coaxially formed at an outside top end portion of said hollow shaft and meshing with said second gear.

11. The roving bobbin exchanging apparatus according to claim 6, wherein said means for restricting a possible change of an axial distance between said first and second pegs of said peg unit, comprises a first base element for a first peg, rigidly mounted on said second slider at a front end position thereof, and a second base element for a second peg, slidably mounted on said second slider in the longitudinal direction thereof, an engaging member secured to said second base and projecting outside therefrom, a stopper surface formed in a side wall of said first slider, and capable of contacting said engaging member, a stop pin disposed on said slide base at forward end portion thereof, and capable of contacting said engaging member, whereby, when said first and second sliders are relatively displaced forward to said slide base by the action of said actuating means of said telescopic mechanism, said engaging member contacts said stop pin of said slide base, during said forward displacing motion of said first and second sliders, so that a further displacing motion of said second peg is stopped, and when said first and second sliders are stopped at the front ends of their forward displacement motion relative to said slide base after said first and second sliders are further displaced forward relatively to said slide base, the axial distance between said first and second pegs becomes identical to a distance (b) which is an axial distance between a pair of a front bobbin hanger and a back bobbin hanger, facing each other, on said creel of said spinning frame, on the other hand, when said first and second sliders are displaced rearwards relative to said slide base, said engaging member of said second peg contacts said stopper surface of said first slider during said rearward displacing motion of said first and second sliders, after creating a condition such that said first and second sliders are still displaced rearward while decreasing an axial distance between said first and second pegs, and when said first and second sliders come to the terminals of their rearward displacement motion, said axial distance between said first and second pegs becomes identical to a distance (a) which is an axial distance between two adjacent bobbin hangers on said supply rail.

12. The roving bobbin exchanging apparatus according to claim 6, wherein said means for restricting a possible change of an axial distance between said first and second pegs of said peg units, comprises a first base element for a first peg, rigidly mounted on said second slider at a front end position thereof, and a second base element for a second peg, slidably mounted on said second slider in the longitudinal direction thereof, a spring continuously pulling said second base element for said second peg in the forward direction, a stopper secured to a second slider for restricting a forward displacement of said second base element for said second peg, an engaging member secured to said second base element for said second peg and projecting outside therefrom, a stop pin disposed on said slide base at forward end portion thereof, and capable of contacting said engaging member, whereby, when said first and second sliders are relatively displaced forward to said slide base by the action of said actuating means for said telescopic mechanism, said engaging member contacts said stop pin of said slide base, during said forward displacing motion of said first and second sliders, so that a further displacing motion of said second peg is stopped, and when said first and second sliders are stopped at the front ends of their forward displacement motion relative to said slide base after said first and second sliders are further displaced forward relative to said slide base, the axial distance between said first and second pegs becomes identical to a distance (b) which is an axial distance between a pair of a front bobbin hanger and a back bobbin hanger, facing each other, on said creel of spinning frame, on the other hand, when said first and second sliders are displaced rearwards relative to said slide base, said first and second sliders are still displaced rearwards while decreasing said axial distance between said first and second pegs, and during such a rearward displacement motion of said first and second sliders, said stopper of said second slide contacts said second base member for said second peg and restricts a free displacement thereof by said stop pin of said slide base, thereafter said axial distance between said first and second pegs becomes identical to said distance (a) between two adjacent bobbin hangers on said supply rail, during a rearward displacement of said first and second sliders, and finally, said rearward displacement motion of said first and second sliders is stopped while maintaining this axial distance between said first and second pegs.

13. The roving bobbin exchanging apparatus according to claim 4, wherein said displacing means comprises a plurality of crank elements forming parts of a parallel crank linkage mechanism for displacing said slide base of said telescopic mechanism along the longitudinal direction of said supply rail by a distance (2C) which is equal to twice said axial distance (C) between two adjacent bobbin hangers on said supply rail, said linkage mechanism is formed by said plurality of crank elements in combination with said slide base and said lifting body, wherein upper end portions of said crank elements are turnably mounted at said slide base, and lower end portions of said crank elements are turnably mounted at said lifting body, and means for actuating said parallel linkage mechanism.

* * * * *